United States Patent [19]

Siegfried

[11] 4,052,071

[45] Oct. 4, 1977

[54] TRAVEL GAME

[76] Inventor: Jack Siegfried, 1154 E. 82nd St., Brooklyn, N.Y. 11236

[21] Appl. No.: 605,679

[22] Filed: Aug. 18, 1975

[51] Int. Cl.[2] ..... A63F 3/04

[52] U.S. Cl. ..... 273/134 AC; 273/134 C; 273/134 D

[58] Field of Search ..... 273/134

[56] References Cited

U.S. PATENT DOCUMENTS

| | | | |
|---|---|---|---|
| 469,089 | 2/1892 | Parker | 273/134 AC |
| 690,273 | 12/1901 | Hambrick | 273/134 AC |
| 707,469 | 8/1902 | Wayts | 273/134 AC |
| 940,855 | 11/1909 | Clemens | 273/134 AC |
| 3,368,816 | 2/1968 | Milazzo et al. | 273/134 AC |

FOREIGN PATENT DOCUMENTS

| | | | |
|---|---|---|---|
| 784,604 | 10/1957 | United Kingdom | 273/134 AC |
| 915,550 | 1/1963 | United Kingdom | 273/134 AC |

*Primary Examiner*—Delbert B. Lowe
*Attorney, Agent, or Firm*—Allen D. Brufsky

[57] ABSTRACT

A board game including a large playing board with a center area showing a map of a country such as the United States, with states, cities, time zones and other features, the perimeter or marginal border of the playing board being divided into a large number of playing boxes, each marked with a direction of play for the player, depending upon which box he enters his marker into under guidance of the dice which are cast by the players. The game includes a quantity of play money, airplane tickets for movement from different cities to others, travel cards for similar movement, and luck cards for good and bad luck plays.

2 Claims, 8 Drawing Figures

TRAVEL GAME

This invention relates to improvements in travel games and the like.

SUMMARY OF THE INVENTION

An object of the invention is to provide a novel and improved travel game device which is played by two or more players on a game board bearing a map of a country, such as the United States.

Another object of the invention is to provide a novel and improved travel game device in which the players are given, by chance, successive steps to take in moving from one location to another on the map of the United States.

A further object of the invention is to provide a novel and improved game device in which there is a map of a country, such as the United States, mounted on a large game board, and around the borders of the game board there are a large number of spaces or squares, each containing travel instructions for the players, beginning at a starting square in one corner, the game including a pair of dice for ascertaining the priorities in play among the players, and an assortment of game cards, such as luck cards, travel cards, airplane tickets, and the like, and also a pile of play money for use in the game.

Still another object of the invention is to provide a novel and improved game device which is educational since it makes each player aware of the geographical location of various cities and states of the United States, as they must, in playing the game, travel figuratively from one point on the map to another, and may be sidetracked along the way so as to delay reaching their particular destination.

Still a further object of the invention is to provide a novel and improved game device which is interesting and exciting, and yet provides a means for relaxation by the players, without risking any real money.

Another object of the invention is to provide a novel and improved game device of the type described, which is simple in design, and which can be manufactured at low cost by mass production methods.

BACKGROUND OF THE INVENTION

In connection with the production and use of games, especially for adults and young adults, it is very important that the game be easy to play, and yet interesting, so that the players will really want to play it. Further, it should be capable of being played by two or more players, and even as many as are at the party or gathering, such as six or eight players.

Introducing the elements of chance into the game will increase the interest and excitement, especially when the players themselves have some control of their method and sequence of playing. The present invention seeks to provide such a game, and it is also educational, involving the geography of a country, such as the United States, and the locations of the cities thereof, as well as modes of travel from one location to another.

BRIEF DESCRIPTION OF THE DRAWINGS

The foregoing and other objects and advantages of the invention will become apparent from the following description of a preferred embodiment thereof, as illustrated in the accompanying drawings, forming a part hereof.

In the drawings.

DETAILED DESCRIPTION OF THE PREFERRED EMBODIMENT

Figure 1:
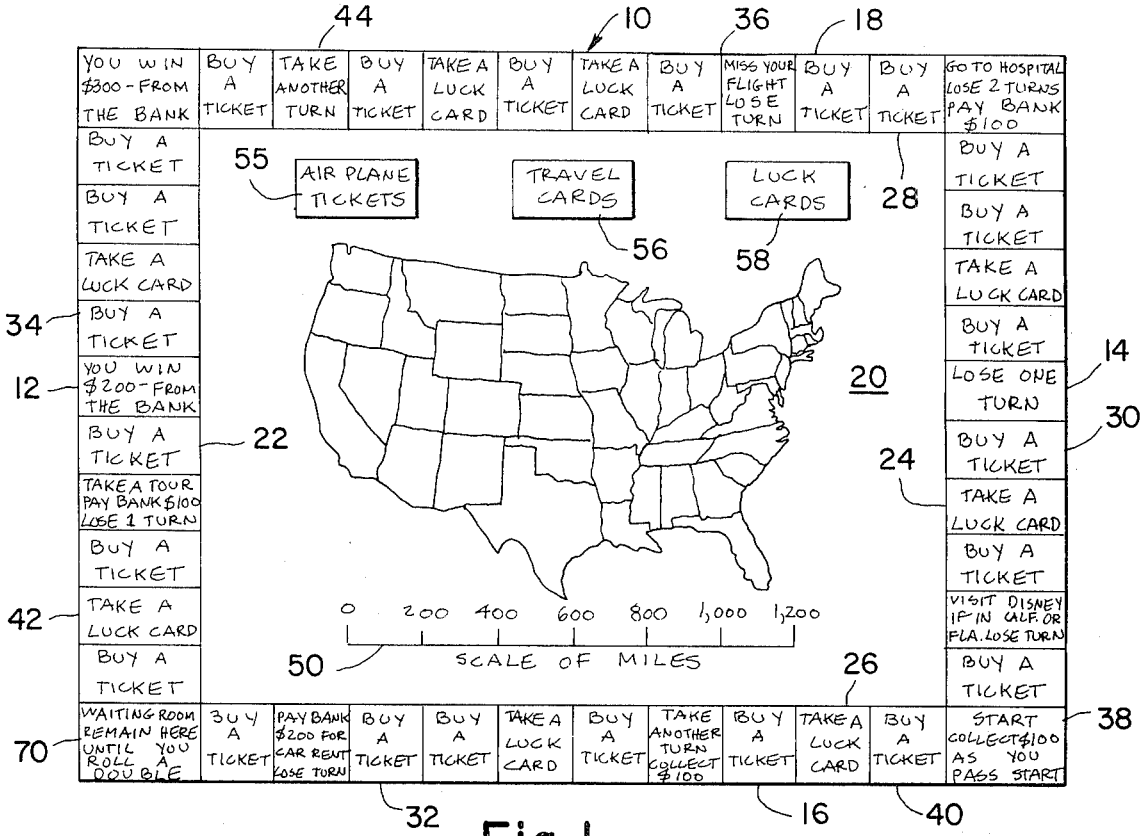
FIG. 1 is a plan view of the game board with the map of the United States in the center, and the large number of squares along the four edges of the game board.
Figure 2:
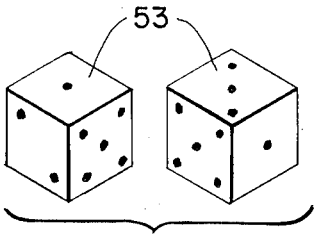
FIG. 2 is a view of a pair of dice used in playing the game.

In order to understand clearly the nature of the invention, and the best means for carrying it out, reference may be had to the drawings, in which like numerals denote similar parts throughout the several views.

As shown, there is a large playing board 10, which may be made of cardboard, plywood, plastic, or even lightweight sheet metal such as aluminum. It has a large area between its left and right side marginal edges 12 and 14, and its front and rear marginal edges 16 and 18. There is also an inner playing area 20, which has left and right side edges 22 and 24, and front and rear edges 26 and 28, and the inner edges are spaced from the neighboring outer edges to define and lay out marginal or border playing areas 30, 32, 34 and 36.

Each of the marginal border playing areas 30, 32, 34 and 36 is in turn divided into successive adjacent marginal play boxes, such as shown at 38, 40, 42, 44 and so on. All of the play boxes carry different identifying legends as shown in FIG. 1, so that play box 38 which is the starting box is marked "START" "Collect $100 As You Pass". Play box 40 is marked "BUY A TICKET", while play box 42 is marked "TAKE A LUCK CARD". Play box 44 is marked "TAKE ANOTHER TURN".

Figure 4:
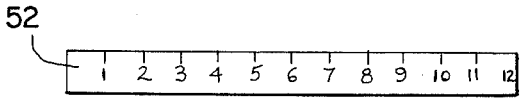
FIG. 4 is a view of a scale ruler used in measuring distances between cities in the game.

The markings on the play boxes are all instructions to the players who must take directions from them in the course of play. As shown in FIG. 1, there is a large map of the United States printed in the central playing area 20 of the playing board, with the various states being shown thereon, and also major cities which are readily located on the map. A scale of miles is shown at 50 in the central area 20 for mileage measurement. And a scale ruler 52 shown in FIG. 4 is used also for measuring distances on the map.

Figure 3:
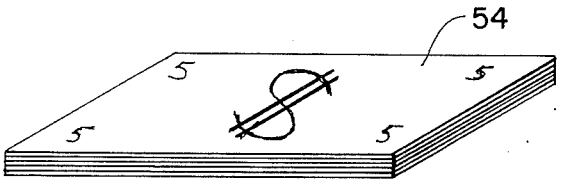
FIG. 3 is a perspective view of a pile of play money used in the game.

The game includes a pair of dice 53 of the usual type, which are to be thrown or rolled by each player as the game starts and proceeds and for giving the order of rotation of each player, and what he has to do. It is also seen that there is a pile of play money 54 shown in FIG. 3, of various denominations, sufficient to play the game, and they may be of large denominations, such as even $1,000 or more, depending on the needs of the game. One of the players is designated to act as the banker who hands out the money as needed and otherwise handles it during the play.

Figure 5:
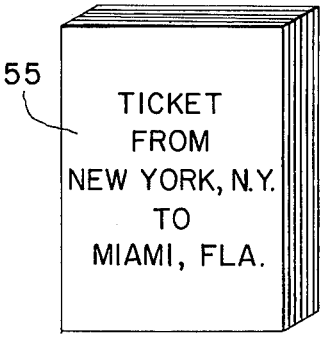
FIG. 5 is a view of a pile of airplane tickets used in the game.
Figure 6:
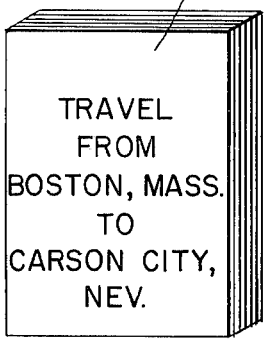
FIG. 6 is a view of a pile of travel cards used in the game.
Figure 7:
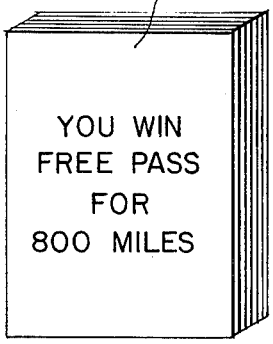
FIG. 7 is a view of a pile of luck cards used in the game.

Further, as seen in FIG. 5, there is a pile 55 of airplane tickets, also shown at 55 on the playing board, the tickets showing a lot of various possible flights from one point to another. Further, there is also a pile of different start and end travel cards 56 shown in FIG. 6, and also at 56 on the game board. In FIG. 7 is shown a pile of LUCK CARDS 58 also shown on the playing board which tell the player what his luck is at the moment during the play.

Figure 8:
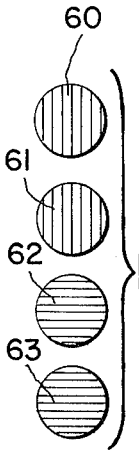
FIG. 8 is a view of colored markers for map locations, boxes, and the like used in the game.

As seen in FIG. 8, there are also a number of MARKERS 60, 61, 62, 63, and so on, which may be small colored discs as used in BINGO games or as poker chips, and are in different colors for each player so that his moves are visible to all players, so that for example there is one red marker 60 for the locations on the map, and a red marker 61 for the marginal playing boxes. For convenience in placing markers on the map, the markers may also be mounted on pins to be stuck into the locations of cities, time zones, capitals and the like on the map to avoid cluttering it up.

As to the mode of playing the game, it is seen that the playing board contains 44 playing boxes or squares and the map of the United States. This game can be played by from two to eight players. All the players roll the dice to determine the order of their turns. The highest one goes first. In case of a tie, the players who are tied roll the dice again. In some instances it might be desirable to list the order of players.

After they have rolled the dice each player takes a TRAVEL card 56 from the pile 56. This card shows the city where presumably they are staying and their destination. Each player places his marker 60 on the city which is on the map of the United States. These TRAVEL CARDS 56 remain open and may be inspected by all the players. As mentioned above, the map markers 60 may be mounted like flags on push-pins so as not to clutter up the map in pinpointing a particular city.

Each player starts with a particular sum of play money, such as $1,000, and one player serves as the banker who handles the money. Then the first player rolls the dice again, followed by the others in turn. They add the numbers on both dice and advance their BOX markers 61 to the proper playing boxes or squares along the margin of the playing board, from the starting box 38 in the lower right hand corner of the playing board and proceeding clockwise.

For example, if a player has a three and five on the dice he counts eight spaces from the starting box 38, which lands his red box marker 61 in the playing box "BUY A TICKET", and he takes the top ticket from the airplane ticket pile 55. If he decides to buy the ticket, he pays the price marked on the ticket to the bank (the banker). If he decides to Pass, he places the ticket on the bottom of the pile 55.

Should the player have the same number on both dice, he has rolled a "DOUBLE", and he may advance the total number of both dice, or the number on one of the dice. He does not move his man or marker on the map unless the ticket is valid from the city where he is to another city. For example, if a player who is in New York City buys a ticket from Chicago to St. Louis, he cannot move to St. Louis until he arrives in Chicago.

It might be wise for him to buy the ticket and save it until he arrives in Chicago, since it would help him to get to his destination. Players should try to accumulate tickets to enable them to get to their final destinations. Players might also find it desirable to accumulate tickets for trading purposes or to sell to another player.

If a player lands on a playing square or box that entitles him to take a Luck card 58 from the pile 58, he takes the top card from the pack 58. Should it say "YOU WIN A FREE PASS FOR 800 MILES", he uses the ruler 52 shown in FIG. 4 to measure that distance from the city where he is to a city 800 miles in any direction. The scale of miles being used is one inch equals 200 miles.

He might win a LUCK card 58 that will entitle him to move to any city in his present time zone or to the next time zone. He might win an OPTION card 58 which will entitle him to force any other player to sell him any ticket he wants. Some of the LUCK cards 58 are not good luck; thus a player might have to pay the bank or other players a certain sum of money.

Should a player land in the WAITING ROOM box 70 shown in the lower left hand cover on FIG. 1, he has to remain there until he rolls a double with the dice or has remained in the waiting room for three turns.

All players who arrive at their destination receive a bonus of $1,000. When a player reaches his destination, he selects another TRAVEL CARD 56. He keeps all the tickets that he has won or paid for. The game can be ended by the players agreeing to end the game at a certain time. The player with the largest amount of money and tickets wins. The players can sell their tickets to the bank or count them as money. The game can be ended if the bank has run out of money. When a player has no money and can't raise money by selling tickets, he is out of the game.

It is thus seen that this is a very interesting and exciting game which includes the elements of skill, chance, luck and calculation by the players.

Although the invention has been described in specific terms, it is understood that various changes may be made in size, shape, materials and arrangement without departing from the spirit and scope of the invention as claimed.

What is claimed is:

1. A game device comprising main game board means with opposite spaced end edges and opposite spaced front and rear edges interconnecting said end edges to delineate and define a main playing board field, an inner playing field having a map disposed thereon carried by said main game board means and spaced from said end edges and said front and rear edges, an outer playing marginal field carried by said main game board means intermediate said inner playing field and said end edges and front and rear edges of said main game board, a plurality of playing boxes carried by said outer playing marginal field, first player marker means constructed for movement sequentially about on said outer playing marginal field, and number selecting gaming means comprising a pair of six sided dice for controlling and regulating said movement of said player marker means, said first player marker means comprising a first plurality of marker discs for placement upon said playing boxes as guides on casting of said dice, second player marker means comprising a second plurality of marker discs for placement upon said map, a plurality of bills of paper play money of various denominations for being played by the players in the game, a plurality of travel cards, each of said travel cards having different starting locations and ending locations locatable on said map, a plurality of different airplane ticket cards to be purchased with the play money, and a plurality of different luck cards, each of said luck cards having a different lucky or unlucky direction for use in playing said game in accordance with the cast of the dice and the play of the game, each of said playing boxes containing directions for the selection of one of said airplane ticket, travel, or luck cards, said airplane ticket, travel, and luck cards disposed in stacks upon said inner playing field and directing the movement of said second plurality of marker discs upon said map.

2. A game device in accordance with claim 1, wherein said map comprises a map of the United States having major cities, states, and the like thereon, said secondary map marker means for movement on said map by the players from one of said cities to another in accordance with the cost of the dice and the play of the game.

* * * * *